United States Patent [19]

Childers et al.

[11] Patent Number: 4,564,037

[45] Date of Patent: Jan. 14, 1986

[54] COIN-QUEUEING HEAD FOR HIGH-SPEED COIN-SORTING AND COUNTING APPARATUS

[75] Inventors: Roger K. Childers, Portland County; Andrew L. Trumbo, Washington County, both of Oreg.

[73] Assignee: Childers Corporation, Wilsonville, Oreg.

[21] Appl. No.: 526,420

[22] Filed: Aug. 25, 1983

[51] Int. Cl.[4] ..... G07D 3/00

[52] U.S. Cl. ..... 133/3 A; 133/3 H

[58] Field of Search ..... 133/3 R, 3 A, 3 B, 3 C, 133/3 D, 3 E, 3 F, 3 G, 3 H, 8 R, 8 A

[56] References Cited

U.S. PATENT DOCUMENTS

| | | | |
|---|---|---|---|
| 2,348,936 | 10/1940 | Sprenger | 133/3 R |
| 2,906,276 | 9/1959 | Blanchette et al. | 133/3 R |
| 2,977,961 | 4/1961 | Buchholz et al. | 133/3 R |
| 3,795,252 | 3/1974 | Black | 133/3 A |
| 3,939,954 | 2/1976 | Collins | 133/8 R X |
| 3,998,237 | 12/1976 | Kressin et al. | 133/3 A |
| 4,086,928 | 5/1978 | Ristvedt et al. | 133/3 A |
| 4,098,280 | 7/1978 | Ristvedt et al. | 133/3 A |
| 4,111,216 | 9/1978 | Brisebarre | 133/3 A |
| 4,234,003 | 11/1980 | Ristvedt et al. | 133/3 A |

FOREIGN PATENT DOCUMENTS

| | | | |
|---|---|---|---|
| 2912016 | 9/1980 | Fed. Rep. of Germany | 133/3 H |

*Primary Examiner*—F. J. Bartuska

*Attorney, Agent, or Firm*—Seed and Berry

[57] ABSTRACT

A coin-queueing head for positioning in a spaced relationship over a rotating flexible surface to process randomly oriented coins of varying diameters and place them in a single layer, single file, having: a central opening in the head for receiving the randomly oriented coins; a plurality of guides to channel the coins into a queue; an engagement wall extending generally transverse to the travel of the queue and projecting to a distance above the surface sufficient to engage and block passage of one of a pair of stacked coins having a first diameter; and a ramp positioned a distance radially inward a peripheral limit along which the queue travels sufficiently to permit unrestricted travel of the pair of stacked coins therebetween, and a distance before the engagement wall defined by the path of travel of the queue to permit unrestricted travel of the blocked coin of the pair of stacked coins therebetween, both distances being less than a second diameter of the coins to be processed having a diameter greater than the first diameter, the ramp projecting to a distance above the surface sufficient to depress any of the coins having the second diameter and a thickness approximating the height of the pair of stacked coins or greater and traveling under the ramp into the flexible surface to permit their unblocked passage under the engagement wall, whereby when the head is operated with the surface rotating the coins reach the sorting channel in a single layer and a single file ready for sorting by denomination, even when processing coins of the second diameter having a thickness approximating or greater than the height of the pair of stacked coins.

14 Claims, 10 Drawing Figures

COIN-QUEUEING HEAD FOR HIGH-SPEED COIN-SORTING AND COUNTING APPARATUS

DESCRIPTION

TECHNICAL FIELD

This invention relates to coin-sorting and counting apparatus, and more particularly, to coin-queueing heads which align coins for subsequent sorting and counting.

BACKGROUND ART

The large and increasing volume of coin-operated machines makes the rapid and accurate sorting and counting of coins an economic necessity. Vending machines, metropolitan area transit systems, pay telephones, and other coin-operated devices have expanded the use of coins and the requirements for economical counting of coins beyond all expectations.

Several machines have been designed for this purposed, exemplified by those disclosed in U.S. Pat. Nos. 2,906,276 (to Blanchette et al.), 3,795,252 (to Black), 4,086,928 (to Ristvedt et al.), and 4,111,216 (to Brisebarre). Each has coin-sorting by centrifugal force according to denomination, counting of the individual denominations by some type of sensing means, and storing and display of the information about the counts during the process. Each also provides for storing and removal of the coins after counting.

In such machines, the centrifugal force is imparted to the coins by the rotation of a disc onto which coins are delivered in bulk, usually through a central hopper. The coins are then guided to deliver them to a position adjacent a peripheral retaining rim of the disc. At the peripheral rim, the coins are selectively engaged according to denomination by one of a plurality of engagement means such as wheels, blades, cams or the like positioned around the peripheral rim. The engagement means depresses or lifts the coins to free them from the peripheral rim of the disc and allows the centrifugal force to hurl them through the air to one of a plurality of corresponding catching devices. The coins are then diverted to appropriate collecting bags. The sorting is typically accomplished by the engagement means based upon the differences in diameter of the various denominations of coins being processed. Conventional engagement means require the coins to be in a single-layer, single-file row at the peripheral rim to avoid malfunctioning of the machine and to insure a proper count. The count is usually made by photoelectric means which sense the number of coins entering each catching device.

The speed at which such machines can sort and count coins is dependent in large part on the ability of the machine to supply coins from the central area of the disc to the peripheral rim. Since the coins are dumped in bulk into the hopper with random orientation, it becomes critical that the coins be properly oriented, arranged in a single layer, and positioned in a single file at the peripheral rim of the disc for engagement by the engagement means. If the process of orienting, arranging and positioning the coins is not accomplished efficiently, the supply of the coins to the engagement means will not be continuous and the operating speed of the machine will be slowed down. Similarly, if the coins get jammed and their flow blocked to the peripheral rim, not only may the flow of coins to the engagement means be noncontinuous, but the jam may cause a drag to be placed on the rotating disc which will decrease its rotational speed and affect the operating speed of the machine. A sufficiently large jam of coins may even stall the rotating disc, requiring disassembly of the machine to clear the jam. In any event, a jam may result in an improper count of coins with some remaining in the machine after the counting is believed complete.

In the past, many of these problems have been handled with the use of guides arranged on a head which is positioned immediately above the rotating disc. Such guides are shown in the Ristvedt et al. and Blanchette et al. patents. The problem of removing one coin from a pair of vertically stacked coins was partially solved in the Brisebarre and Black patents by the use of a ring or strip which presents an edge wall spaced above the rotating disc to knock off a top coin of a pair of stacked coins. The edge wall is spaced far enough above the rotating disc to let the thickest single coin pass thereunder, but yet low enough to allow only one of the thinnest coins to pass under the edge wall at a time. In other words, a vertical stack of two or more of the thinnest coins will not pass under the edge wall and the top coins will be knocked off the stack. This presupposes that the height of a stack of two of the thinnest coils being handled by the machine is appreciably larger than the thickness of the thickest coin being processed by the machine. If the stack of the thinnest coins is equal to or less than the thickness of the thickest coin, the edge wall will pass over the stack of two thin coins and fail to knock off the top coin. With United States coins currently in circulation, a stack of two dimes is approximately equal to the thickness of a half-dollar. As such, it becomes difficult to avoid having a pair of stacked dimes reach the engagement means, and care must be taken to avoid processing a mixture of coins having dimes and half-dollars. The same problems are encountered when processing coinage of other nations.

The use of such an edge wall causes other problems even when only processing coins with a thickness less than the height of a double stack of the thinnest coins, such as quarters and Susan B. Anthony dollars United States coinage, because coins which are not laying completely flat immediately prior to passing under the edge wall as a result of machine vibration or otherwise, may be engaged by the edge wall. The blocked coin must then be diverted away and recirculated through the machine. This tends to slow up the machine and disrupt its smooth operation, particularly when the edge wall is positioned between the head and the rotating disc along the path of travel of the coins.

It will therefore be appreciated that there has been a significant need for a queueing head for such high-speed coin-sorting and counting apparatus which is able to properly orient, arrange into a single layer, and position in single file coins of various thicknesses. The present invention fulfills this need and provides other related advantages.

DISCLOSURE OF INVENTION

The present invention resides in a coin-queueing head positionable in a spaced relationship over a rotating flexible surface to process randomly oriented coins of varying diameters and place them in a single layer, single file, the head having guide means for guiding the randomly oriented coins to provide a queue of coins including stacked pairs of coils having a first diameter and other ones of the coins having a larger second diameter; engagement means for engaging and blocking passage of one of the stacked pair of coins; and a coin-depressing means positioned in the path of travel of the queue forward of the engagement means for permitting unrestricted travel of the stacked pair of coins to the engagement means and for depressing coins having the second diameter into the flexible surface for travel unrestricted by the engagement means, whereby when the head is operated with the surface rotating the coins are processed into a single layer and a single file ready for sorting by denomination, even when processing coins of the second diameter having a thickness approximately or greater than the height of the stacked pair of coins.

More specifically, the engagement means is an engagement member extending generally transverse to the path of travel of the queue and projecting to a distance above the surface sufficient to engage and block passage of one of the stacked pair of coins. The engagement member diverts the blocked coin into a recirculation area for further guiding by the guiding means for reentry into the queue. The coin-depressing means is a coin-depressing member positioned to permit unrestricted travel of the stacked pair of coins and to engage coins having the second diameter, the coin-depressing member projecting to a distance above the surface sufficient to depress coins having the second diameter traveling under the coin-depressing member into the flexible surface sufficient to permit their unblocked passage under the engagement member.

The coin-depressing member is positioned a distance forward of the engagement member, as defined by the path of travel of the queue, sufficient to permit unrestricted travel of the blocked coin between the coin-depressing member and the engagement member, but insufficient for coins of the second diameter to raise from the flexible surface sufficiently to engage and be blocked by the engagement member. The distance the coin-depressing member is positioned before the engagement member is greater than the first diameter, but less than the second diameter. The coin-depressing member has a ramp cross-section, the ramp sloping toward the path of travel of the queue.

The coin-queueing head also includes a central opening in the head for receiving said randomly oriented coins; a first peripheral limit extending partialy about the central opening and positioned a first distance from the central opening to define a coin recirculation area and limit outward radial travel of the coins; a first guide extending partially about the central opening generally opposite the first peripheral limit and positioned adjacent to the central opening, the first guide having a portion extending sufficiently around the central opening to define a coin-queueing channel between the portion and a portion of the first peripheral limit coextensive with the first guide portion for receiving coins from the recirculation area, the first guide projecting to a second distance above the surface sufficient to depress any of the coins traveling thereunder into the flexible surface to substantially maintain the radial position of the coins as the surface rotates to deliver said coins back into the recirculation area; and a second peripheral limit extending partially about the central opening and positioned a third distance from the central opening greater than the first distance and radially outward of the first guide, to define a coin-processing area between the second peripheral limit and the first guide and limit outward radial travel of said coins, for receiving coins from said coin-queueing channel. In a preferred embodiment, the engagement member is an engagement wall extending generally transverse to the travel of the coins beyond said coin processing area, the wall extending from the second peripheral limit to the first peripheral limit, and projecting to a fourth distance above the surface sufficient to engage and block passage of one of a pair of stacked coins having a first diameter, the wall being spaced apart from the first guide to define a recirculation passageway therebetween communicating the coin-processing area with the recirculation area, the blocked coin being diverted by the wall back into the recirculation area through the reentry passageway. The coin-depressing member is a ramp positioned in the coin-processing area a fifth distance radially inward of the second peripheral limit sufficiently to permit unrestricted travel of the pair of stacked coins therebetween, the fifth and sixth distances being less than a second diameter of the coins to be processed having a diameter greater than the first diameter, the ramp projecting to a seventh distance above the surface sufficient to depress any of the coins having the second diameter traveling under the ramp into the flexible surface to permit their unblocked passage under the engagement wall. The head also includes a third peripheral limit extending partially about the central opening and positioned an eighth distance from the central opening, radially outward of the first peripheral limit, to define a coin-sorting channel between the third peripheral limit and a portion of the first peripheral limit coextensive with the third peripheral limit; and a reentry passageway between the first and second peripheral limits for return to the coin-processing area of the coins passing from the coin-sorting channel which remain unsorted.

Other features and advantages of the invention will become apparent from the following detailed description, taken in conjunction with the accompanying drawings.

BEST MODE FOR CARRYING OUT THE INVENTION

Figure 1:
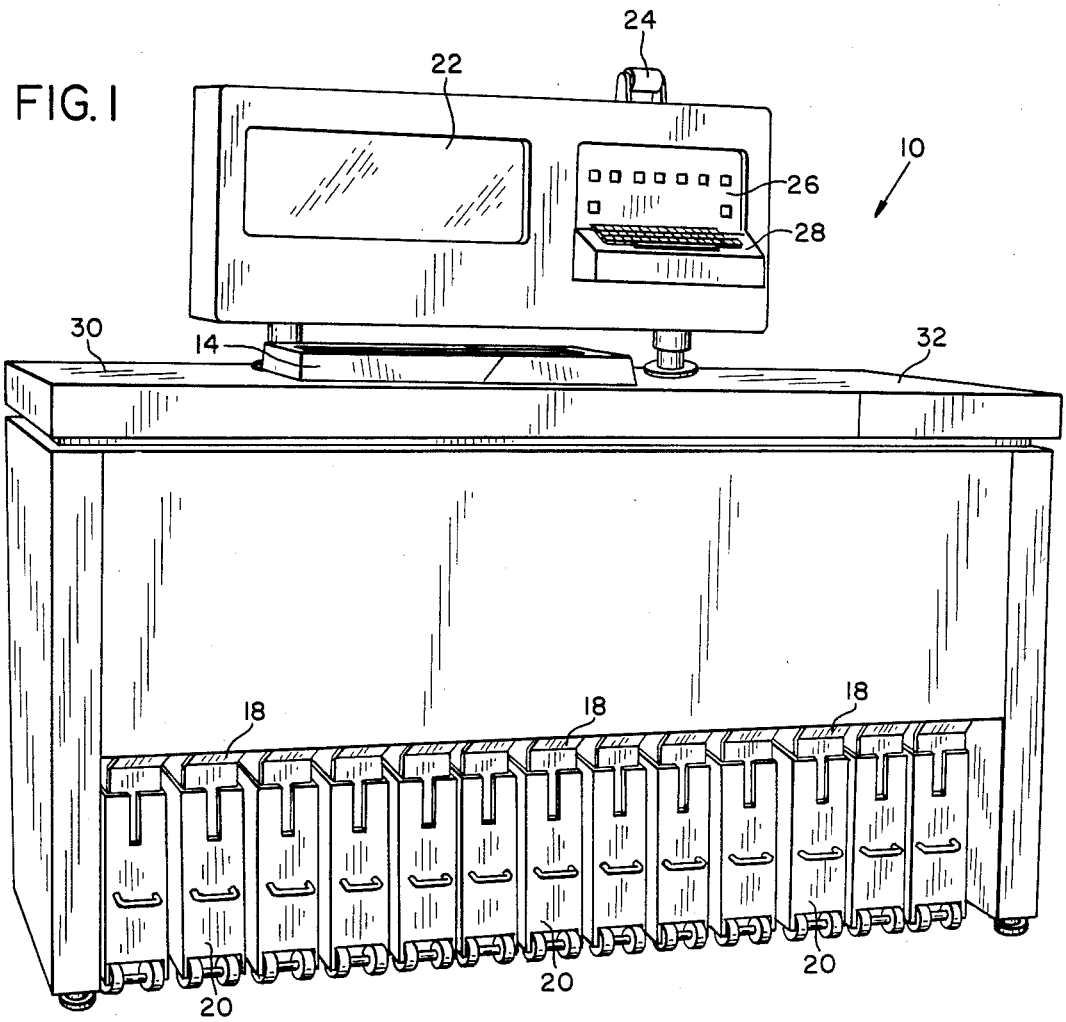
FIG. 1 is an isometric frontal view of a coin-sorting and counting apparatus, embodying the improved coin-queueing head of the present invention.
Figure 2:
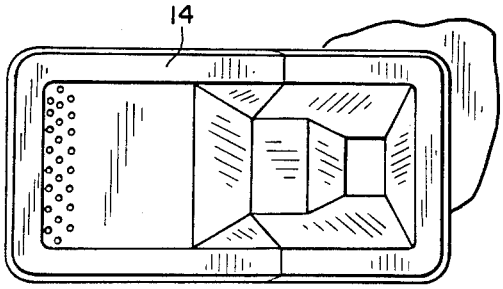
FIG. 2 is an enlarged, fragmentary top plan view of the coin loading tray of the apparatus shown in FIG. 1.
Figure 4:
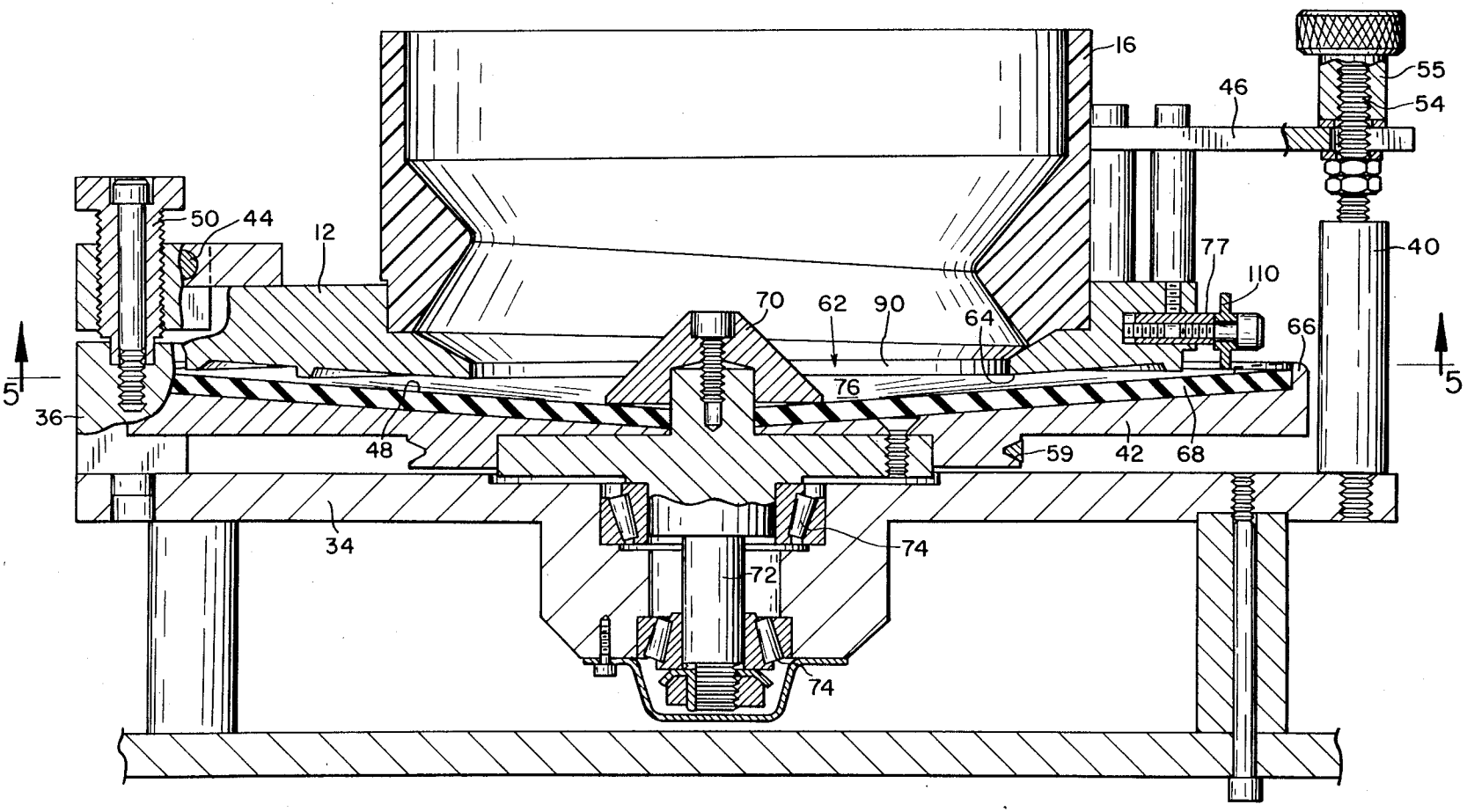
FIG. 4 is an enlarged, fragmentary, sectional view taken substantially along the line 4—4 of FIG. 3.

As shown in the drawings for purposes of illustration, the present invention is embodied in a high-speed coin-sorting and counting apparatus, indicated by reference numeral 10. More specifically, the present invention is embodied in an improved coin-queueing head 12 for such an apparatus. Referring to FIGS. 1, 2 and 4, an undifferentiated mix of coins with random orientation is poured into a loading tray 14 of the apparatus 10 and moves therefrom into a hopper 16 located beneath the tray and immediately above the queueing head 12. The queueing head 12, in conjunction with the other parts of the apparatus 10, operates to separate, sort, count and distribute the coins into a plurality of coin bags 18 which are each mounted in one of a plurality of coin-bag-holding receptacles 20, of which there are at least two for each denomination of coin.

In the presently preferred embodiment of the invention, when designed to handle United States coinage, the apparatus processes simultaneously pennies, nickels, dimes, quarters, half-dollars, and Susan B. Anthony dollar denomination coins. When one of the coin bags 18 is full with a preselected number of coins deposited in it, the flow of coins is switched into an adjacent coin bag, and an alarm sounds and an indicator lights up to signal an operator (not shown) to withdraw the receptacle 20 containing the full bag and replace it with another receptacle containing an empty bag. Visual indicators positioned on a display panel 22 are also provided to show the state of the individual coin bags held by the various receptacles 20. The display panel 22 also has visual indicators which show that a particular one of the coin bags 18 needs attention.

The display panel 22 shows the number of coins of each denomination which has been counted in a particular batch, the value of the counted coins, the subtotal for a particular bag of a batch, and the total for the batch. In addition, an alpha-numeric printer 24 prints out the information concerning a particular bag, batch or run as desired. An electronic memory (not shown) is used to match up the information of present batches with that of other batches for a particular customer.

Another display panel 26 is provided and is associated with a computer terminal keyboard 28 used to program a specific sorting and counting routine desired for a particular batch of coins. The keyboard 28, in addition to being connected to an internal microprocessor may also be connected through a cable to an external computer. Flat counter surfaces 30 and 32, located to each side of the loading tray, are provided as work space.

Figure 3:
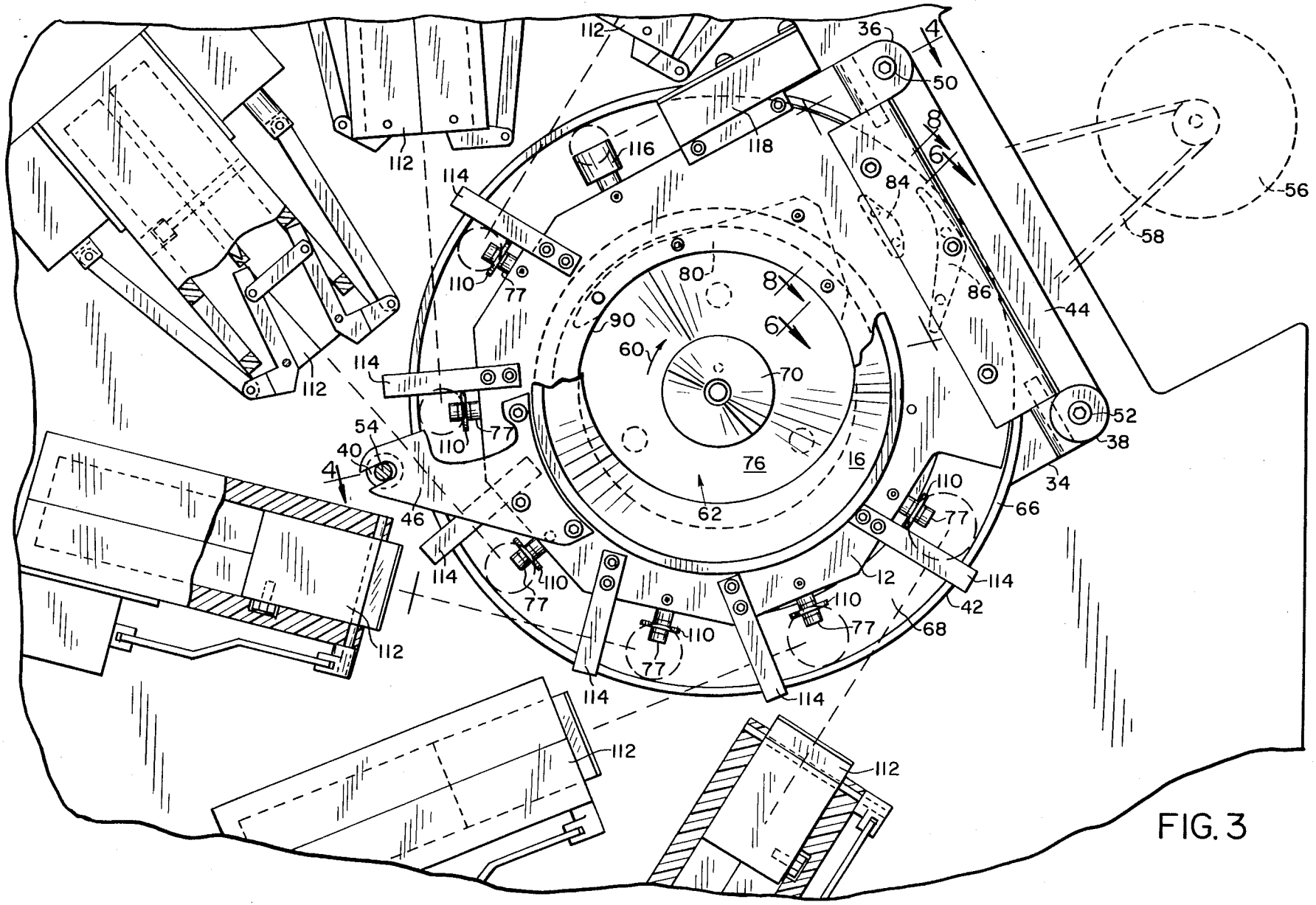
FIG. 3 is a fragmentary, top plan view of the coin-queueing head of the present invention shown positioned above a rotatable disc with coin catching devices arranged around the head.
Figure 5:
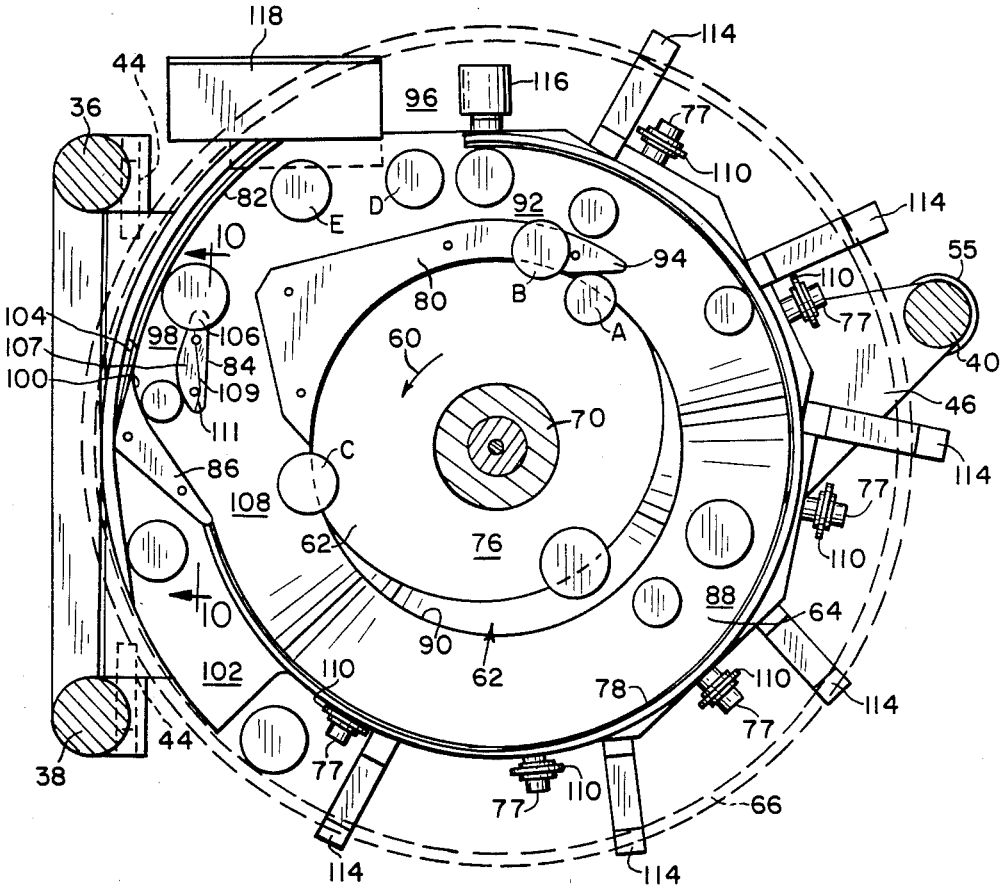
FIG. 5 is a reduced sectional view taken substantially along the line 5—5 of FIG. 4 showing the underside of the coin-queueing head without the hopper and with coins shown at various positions.

As shown in FIGS. 3, 4, and 5, the apparatus 10 includes a stationary support base 34 which has three upright supports 36, 38 and 40 attached thereto and which supports a rotatable, circular disc 42. The queueing head 12 is attached by a hinge 44 to two of the upright supports 36 and 38 and by a flange 46 to the upright support 40 for holding the head in position above an upper surface 48 of the disc 42 by approximately the thickness of the thickest coin to be processed by the apparatus 10. The precise vertical position of the head 12 above the upper surface 48 is adjustable through adjustment bolts 50, 52 and 54, which hold the hinge 44 and the flange 46 to the upright supports 36, 38 and 40. The hinge 44 permits easy lifting of the head 12 away from the disc 42 for inspection, cleaning and clearing of any obstructions which may occur. The bolt 54 includes a thumb-operated cap 55 which may be readily unscrewed to permit the head 12 to be moved about the hinge 44. As shown in FIG. 4 by phantom lines, a motor 56 drives the disc 42 through a belt 58 to rotate it in a clockwise direction indicated by arrow 60 when viewed from above. The belt 58 rides on a pulley 59 formed as an integral part of the disc 42. The rotation of the disc 42 imparts a centrifugal force to the coins being processed.

The hopper 16 is rigidly attached to and supported above the queueing head 12, and has a corkscrew interior shape. The coins moved into the hopper are funneled into a central circular opening 62 in the head. A lower surface or face 64 of the head 12 faces toward the upper surface 48 of the rotating disc 42 and is tapered upwardly from the central opening 62 to its outer perimeter at an angle of approximately four degrees. The taper of the lower surface 64 of the head 12 conforms with the taper on the upper surface 48 of the disc 42. The taper is provided to facilitate holding coins down on the upper surface 48 of the disc 42, particularly when they reach a peripheral rim 66 of the disc. A resilient frictional pad 68 covers the disc 42 and defines the upper surface 48 of the disc. The lower surface 64 of the head 12 is a low-friction surface, preferably made of a durable metal surface. A conical member 70 is fixedly attached to the disc 42, at its center, below the central opening 62, to prevent coins from remaining in the center of the disk by their avoiding the centrifugal force caused by rotation of the disc. The centrifugal force is necessary to move the coins from the central opening 62 to the peripheral rim 66. The disc 42 is rotatably mounted to the base 34 by a shaft 72 supported by a pair of frictionless roller bearings 74.

Turning now to FIG. 5, the bottom face of the queueing head 12 is shown. It is to be remembered that in the description which follows, based on FIG. 5, the viewer is facing upward and the rotating disc 42 (shown by phantom lines) is spaced toward the viewer by about the thickness of the thickest coin to be processed by the apparatus 10. As the coins come through the central circular opening 62 of the head 12 they enter a loading area 76 and encounter the centrifugal force generated by the rotating upper surface 48 of the disc 42. The centrifugal force is imparted to the coins by their contact with the resilient frictional pad 68. The disc 42 rotates in the direction shown by the arrow 60 (the direction of rotation is counterclockwise since it is being viewed in FIG. 5 from below). Consequently, the coins tend to move in a spiral direction away from the loading area 76 and into the space between the lower surface 64 of the head 12 and the upper surface 48 of th disc 42. While the coins travel between the stationary head 12 and the rotating disc 42 under the urging of the centrifugal force, they are guided and separated to place them in a non-stacked, single-file flow by the time they reach the peripheral rim 66, whereat coin-engaging means 77, as will be described in more detail below, sort the coins one at a time.

As best shown in FIGS. 4 and 5, first through fifth guides 78, 80, 82, 84 and 86 are attached to and project downward from the lower surface 64 of the head 12 by various amounts toward the upper surface 48 of the disc 42. These five guides are shaped and arranged on the lower surface 64 of the head 12 in such a way as to channel the coins into a queue to be sorted. From the loading area 76, the coins first enter a recirculation area 88, which extends more than halfway around the central opening 62 and which is defined along its outer perimeter by the first guide 78. The first guide 78 is a circumferential retaining wall which projects downward to nearly the upper surface 48 of the disc 42 and which forms a barrier to radial travel of the coins while they are in the recirculation area 88. By the time coins have entered the recirculation area 88, many stacked coins will have already been placed in a single layer by an inner circumferential edge wall 90 defining the central opening 62 of the head 12. The edge wall 90 tends to knock the upper stacked coin off the stack as the coins enter the space between the lower surface 64 of the head 12 and the upper surface 48 of the disc 42; however, a double stack of the thinnest coins, such as dimes, is too short to be acted on by the edge wall when the height above the disc is set for processing coin batches including large coins, such as half-dollar coins. Consequently, the thinner coins may travel in a stacked configuration through the space between the head and the disc. As will be described below, the present invention will remove the upper coin from a stack even when the stack of coins has a height equal to or less than the thickness of the thickest coin being sorted.

Positioned on the other side of the central opening 62 generally opposite the first guide 78 is the second guide 80, which extends partially around the central opening. The first guide 78 extends around sufficiently beyond the recirculation area 88 to overlap with the second guide 80 and define a queueing passageway 92 therebetween having a width somewhat greater than that of the largest diameter coin being processed, and preferably slightly less than two times the diameter of the smallest diameter coin being processed to break up any coins edgewise locked together in an equilateral triangular arrangement. Coins not in a queue positioned adjacent to the peripheral first guide 78 will pass under the second guide 80. The second guide 80 projects downward to a distance above the upper surface 48 of the disc 42 sufficient to press any coins passing thereunder into the resilient pad 68 to hold the coins in their radial position until the rotation of the disc carries the coins beyond the second guide and back into the recirculation area 88. A leading tip 94 of the second guide 80 gradually tapers downward from the lower surface 64 of the head 12 to the full downward projection of the second guide 80 to allow coins to pass smoothly under the second guide.

A line, or queue, of coins starts to form against the peripheral first guide 78 in the recirculation area 88, with other coins edge-stacked against the queue inwardly of the queue. When the queue reaches the beginning of the passageway 92, the coins edge-stacked against them encounter the leading tip 94 of the second guide 80, and either are thrown back into the loading area 76, as illustrated by coin A, or pass under the leading tip 94, as illustrated by coin B. As discussed above, coins passing under the leading tip 94 are held in their radial position by the pressure the second guide 80 applies against the coin on top and the pressure of the resilient pad 68 underneath until they pass into the recirculation area 88, as illustrated by coin C.

As the queue of coins passes through the passageway 92, the coins eventually travel past the end of the first guide 78 and are no longer restrained thereby. The coins then start to slide outward moved by the centrifugal force, as illustrated by coins D and E, at the same time as they are urged forward by the rotation of the disc 42. As will be described below, the area just beyond the end of the first guide 78 is a reentry area 96 where any coins not hurled from the disc 42 by the coin-engaging means 77 will reenter the queue. The outward travel of the coins through the reentry area 96 continues until the coins engage the third guide 82. The third guide 82 is a circumferential retaining wall positioned radially farther from the central opening 62 than the first guide 78, and, like the first guide, projects downward to nearly the upper surface 48 of the disc 42 to form a barrier to the radial travel of the coins.

The coins are guided along by the peripheral third guide 82 into a de-stacking area 98. Within the de-stacking area 98 is the fourth guide 84 and the fifth guide 86. The fifth guide 86 has an arcuate leading edge 100 positioned generally transverse to the flow of coins through the de-stacking area 98, and projects downward from the lower surface 64 of the head 12 toward the upper surface 48 of the disc 42 to allow single coins with certain thicknesses to pass thereunder, but not others, as will be described in more detail below. The rotating disc 42 carries coins which pass under the fifth guide 86 into a sorter channel 102.

The fifth guide 86 has an entry tip 104 positioned adjacent to the third guide 82 with a curvature which forms a smooth contour with the third guide 82. The curve of the leading edge 100 of the fifth guide 86 has a radius of curvature substantially greater than the diameter of the largest diameter coin to be processed, and the fifth guide projects downward toward the upper surface 48 with gradual sloping or ramp profile in the area of the leading edge to facilitate capturing of coins under the fifth guide for their travel to the sorting channel 102.

Figure 7:
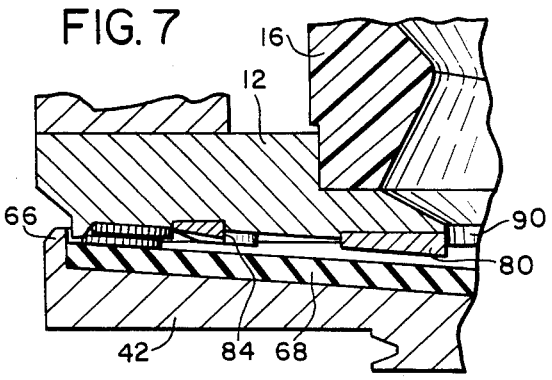
FIG. 7 is an enlarged, fragmentary, sectional view taken substantially along the line 6—6 of FIG. 3, showing a double stack of thinner coins being processed.
Figure 8:
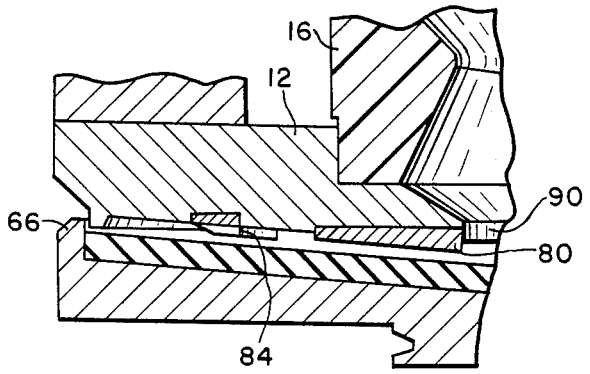
FIG. 8 is an enlarged, fragmentary, sectional view taken substantially along the line 8—8 of FIG. 3.

The precise amount by which tthe fifth guide 86 projects downward at the leading edge 100 toward the upper surface 48 of the disc 42 is determined by thicknesses of the coins being processed. More particularly, the distance of the fifth guide 86 above the upper surface 48 is to be less than the height of a double stack of the thinnest coins being sorted, i.e., for United States coinage, a double stack of dimes. As such, the leading edge 100 of the fifth guide 86 knocks the upper dime off the stack (see FIG. 7). With some coinage, the thickness of the thicker coins being sorted is very close to the height of a double stack of the thinner coins. Consequently, while the leading edge 100 will knock off the top coin of the stack, it will also prevent passage of some of the thicker coins unless special provisions are made. Such is the case with United States half-dollars, which have a thickness close to the height of a double stack of dimes. Additionally, coins which are thin enough to pass under the leading edge 100 when lying flat will be blocked by the leading edge when not in a flat resting position due to vibration or other causes. As will be described below, these problems are avoided by use of the fourth guide 84.

Figure 6:
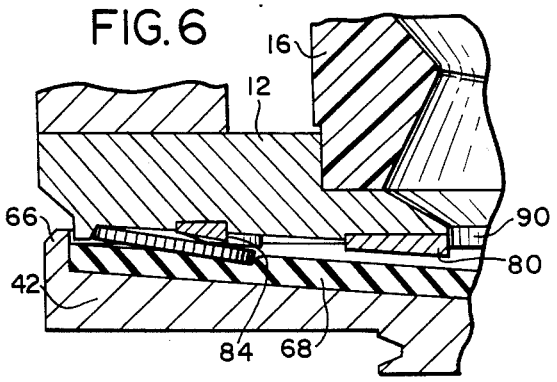
FIG. 6 is an enlarged, fragmentary, sectional view taken substantially along the line 6—6 of FIG. 3, showing a larger diameter coin being processed.
Figure 9:
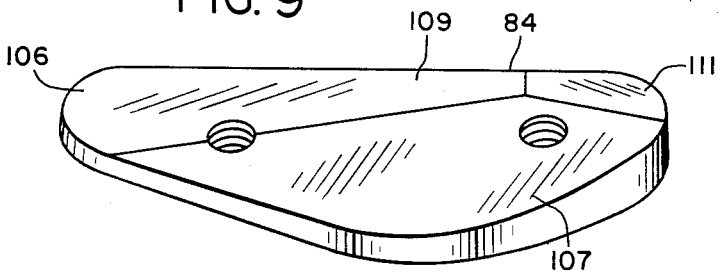
FIG. 9 is an enlarged isometric view of the coin-depressing ramp of the present invention.
Figure 10:
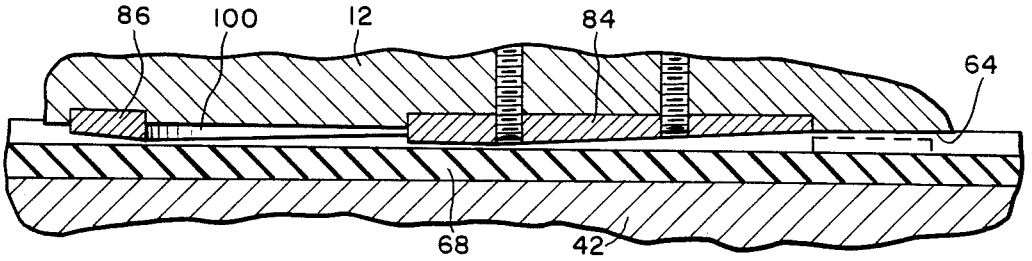
FIG. 10 is an enlarged, fragmentary, sectional view taken substantially along the line 10—10 of FIG. 5.

To pass the thicker coins under the fifth guide 86, the fourth guide 84 is positioned radially inward from the peripheral third guide 82 and in front of the fifth guide by a distance approximately equal to or greater than the diameter of the thinnest coin to be processed, which, when double stacked, presents the stacking problem described above. The fourth guide 84 projects downward from the lower surface 64 of the head 12 toward the upper surface 48 of the disc 42 with a gradual sloping or ramp profile along a leading end portion 106 of the fourth guide, and projects downward with a gradual sloping or ramp profile along a radially outward portion 107. The fourth guide 84 also has a radially inward portion 109 which projects downward sufficiently to press the thicker coins into the resilient pad 68 far enough to hold them below the leading edge 100 as the disc 42 carries them to the fifth guide 86, thereby allowing their passage thereunder and into the sorter channel 102 (see FIGS. 6 and 9). The fourth guide 84 has an upwardly inclined trailing end portion 111. Another function believed served by the fourth guide 84 is to stabilize and hold flat all coins in preparation for their passage under the fifth guide 86, and avoids the problems which can result from coin vibration. Should a coin, for some reason, not be sufficiently depressed and engage the leading edge 100, a recirculation passageway 108 is provided between the second and fifth guides 80 and 86 to allow the coin to pass back into the recirculation area 88. As will be described below, the knocked off top coin of the double stack of the thinnest coins also passes back into the recirculation area 88 through the recirculation passageway 108.

The positioning of the fourth guide 84 apart from the third guide 82 by at least the diameter of the thinnest coin allows a stack of the thinnest coins to pass between the third and fourth guides without being pressed into the relsilient pad 68 by the fourth guide and, consequently, when reaching the fifth guide 86, the leading edge 100 of the fifth guide knocks off the top coin. Since the thicker coins generally have a diameter greater than the diameter of the thinnest coin, the thicker coins in the queue which is formed along the third guide 82 will not avoid the fourth guide 84, and will be pressed into the resilient pad 68 by the fourth guide for passage under the fifth guide unimpeded by the leading edge 100 of the fifth guide. This is even though some of the thicker coins may have a thickness equal to or greater than the height of the double stack of the thinnest coins. The space provided between the third and fourth guide also helps prevent edge-stacked, smaller diameter coins from both passing under the fifth guide 86 into the sorter channel 102. The positioning of the fourth guide 84 apart from the fifth guide 86 by at least the diameter of the thinnest coin allows the knocked off top coin of the double stack of the thinnest coins to pass between the fourth and fifth guides and back into the recirculation area 88 through the recirculation passageway 108.

The coins passing under the fifth guide 86 and into the sorter channel 102 are arranged and positioned in a single layer, in single file. The coins travel through and leave the sorting channel 102 under the influence of the rotating disc 42, whereupon they are free of any control by the head. The disc 42 then carries the coins in a queue which is positioned adjacent to the peripheral rim 66 of the disc to the coin-engaging means 77 for sorting by denomination.

The coin-engaging means comprises a plurality of coin-depressing sorting wheels 110, rotatably mounted to the head 12 and spaced along the outer perimeter of the head. In conventional fashion the sorting wheels 110 extend from the head by varying distances corresponding to the diameter of the coin to be depressed, with the largest diameter coin being sorted first, then the next largest second, and so on. For United States coinage, the apparatus 10 will process and sort six denominations of coins in the same batch, i.e., penny, nickel, dime, quarter, half-dollar and Susan B. Anthony dollar coins. The sorting wheel 110 depresses the inner edge of a coin into the resilient pad 68 causing the outer edge to raise and be hurled over the peripheral rim 66 of the disc 42 by the centrifugal force into a coin catching device 112. The coins are counted by an electro-optical sensor 114 as the coins are travelling through the air. One catching device 112 is positioned across from each sorting wheel 110. Should for some reason a coin not be hurled from the disc 42, a last wheel 116 is provided of a width sufficient to engage all diameter coins being processed and cause a coin to be sufficiently pressed into the resilient pad 68 and bounced upwardly therefrom by resiliency of the pad that the centrifugal force will hurl it off the disc 42 into a chute 118 which diverts the coin into a special holding compartment (not shown). Should a coin not be hurled from the disc 42 by the action of the sorting wheels 110 or the ast wheel 116, it will travel around the peripheral rim 66 until it comes to the reentry area 96 whereupon the coin will pass through the opening between the adjacent ends of the first and third guides 78 and 82, and again move under the head 12 and reenter the queue.

It will be appreciated that, although a specific embodiment of the invention has been described herein for purposes of illustration, various modifications may be made without departing from the spirit and scope of the invention. Accordingly, the invention is not limited except as by the appended claims.

We claim:

1. A coin-queueing head positionable in a spaced relationship over a rotating flexible surface to process randomly oriented coins of varying diameters and place them in a single layer, single file, comprising:

guide means for guiding said randomly oriented coins to provide a queue of coins including stacked pairs of coins having a first diameter and other ones of said coins having a larger second diameter;

engagement means for engaging and blocking passage of one of said stacked pair of coins;

a coin-depressing means positioned in the path of travel of said queue for permitting unrestricted travel of said stacked pair of coins to said engagement means and for depressing coins having said second diameter into said flexible surface for travel unrestricted by said engagement means, whereby when said head is operated with said surface rotating said coins are processed into a single layer and a single file ready for sorting by denomination, even when processing coins of said second diameter having a thickness approximating or greater than the height of said stacked pair of coins.

2. The coin-queueing head of claim 1 wherein said coin-depressing means is further positioned for blocking travel of edge stacked pairs of coins having said first diameter.

3. The coin-queueing head of claim 1, wherein said engagement means is an engagement member extending generally transverse to the path of travel of said queue and projecting to a distance above said surface sufficient to engage and block passage of one of said stacked pair of coins.

4. The coin-queueing head of claim 3 wherein said engagement member diverts said blocked coin into a recirculation area for further guiding by said guiding means for reentry into said queue.

5. The coin-queueing head of claim 3 wherein said coin-depressing means is a coin-depressing member positioned to permit unrestricted travel of said stacked pair of coins and to engage coins having said second diameter, said coin-depressing member projecting to a distance above said surface sufficient to depress coins having said second diameter traveling under said coin-depressing member into said flexible surface sufficient to permit their unblocked passage under said engagement member.

6. The coin-queueing head of claim 5 wherein said coin-depressing member is positioned a sufficient distance before said engagement member, as defined by the path of travel of said queue, to permit unrestricted travel of said blocked coin between said coin-depressing member and said engagement member, but insufficient for coins of said second diameter to raise from said flexible surface sufficiently to engage and be blocked by said engagement member.

7. The coin-queueing head of claim 6 wherein said distance said coin-depressing member is positioned before said engagement member is greater than said first diameter, but less than said second diameter.

8. The coin-queueing head of claim 7 wherein said coin-depressing member has a ramp cross-section, said ramp sloping toward the path of travel of said queue.

9. The coin-queueing head of claim 8 wherein said coin-depressing member slopes radially outward.

10. The coin-queueing head of claim 5 wherein said coin-depressing member is positioned to block travel to said engagement means of one of a pair of edge stacked coins of said first diameter.

11. The coin-queueing head of claim 1 wherein said coin-depressing means is a rising ramp sloping toward the path of travel of said queue.

12. A coin-queueing head positionable in a spaced relationship over a rotating flexible surface to process randomly oriented coins of varying diameters and place them in a single layer, single file, comprising:

a central opening in said head for receiving said randomly oriented coins;

a first peripheral limit circumferentially extending partially about said central opening and positioned radially distant from said central opening to define a coin circulation area and limit outward radial travel of said coins;

a guide extending partially about and positioned adjacent to said central opening, radially inward of said first peripheral limit, said guide having a portion circumferentially coextensive with a first portion of said peripheral limit and spaced apart therefrom by slightly greater than the diameter of the largest diameter coin of said coins to define a coin-queueing channel therebetween for receiving coins from said circulation area to form a single file queue against said first peripheral limit, at least said first portion of said guide projecting to a distance above said surface sufficient to depress any of said coins positioned radially iwnard of said first peripheral limit sufficient to travel thereunder into said flexible surface to substantially maintain the radial position thereof as said surface rotates for their delivery back into said circulation area;

a second peripheral limit circumferentially extending partially about said central opening and positioned radially outward of said first peripheral limit to define a coin-processing area between a second portion of said guide and said second peripheral limit and limit outward radial travel of said coins received from said coin-queueing channel;

an engagement wall extending generally transverse to the travel of said coins beyond said coin processing area, said wall extending substantially from said second peripheral limit to said first peripheral limit, and projecting to a distance above said surface along a portion of said wall adjacent to said second peripheral limit sufficient to engage and block passage of one of a pair of face-stacked coins having a first diameter, said wall being spaced apart from said guide to define a recirculation passageway therebetween, said blocked coin being diverted by said wall back into said circulation area through said recirculation passageway; and a ramp positioned in said coin-processing area a distance radially inward of said second peripheral limit sufficient to permit unrestricted travel of said pair of face-stacked coins therebetween, said distance being less than a second diameter of said coins to be processed which have a diameter greater than said first diameter, said ramp projecting to a distance above said surface sufficient to depress any of said coins having said second diameter traveling under said ramp into said flexible surface to permit their unblocked passage under said engagement wall, whereby when said head is operated with said surface roating said coins pass under said engagement wall in a single layer and a single file ready for sorting by denomination, even when processing coins of said second diameter having a thickness approximating or greater than the height of said pair of faced-stacked coins with said first diameter.

13. The coin-queueing head of claim 12 wherein said ramp is positioned a distance before said engagement wall, as defined by the direction of rotation of said surface, to permit unrestricted travel of said blocked coin of said pair of face-stacked coins therebetween, said distance being less than said second diameter.

14. The coin-queueing head of claim 12, further including a reentry passageway between said first and second peripheral limits for return to said coin-processing area of any of said coins passing under said engagement wall which remain unsorted.

* * * * *